US005102228A

United States Patent [19]

Vine-Lott

[11] Patent Number: 5,102,228

[45] Date of Patent: Apr. 7, 1992

[54] APPARATUS AND METHOD FOR PRODUCING FOAMED MATERIALS

[75] Inventor: Keith Vine-Lott, Hyde, England

[73] Assignee: Thermal Structures Limited, United Kingdom

[21] Appl. No.: 405,530

[22] Filed: Sep. 11, 1989

[30] Foreign Application Priority Data

Mar. 9, 1988 [WO] PCT Int'l Appl. ... PCT/GB88/00175

[51] Int. Cl.[5] ..... B28C 5/02; B28C 7/04

[52] U.S. Cl. ..... 366/3; 366/8; 366/10; 366/17; 366/19; 366/21; 366/33; 366/51; 366/132; 366/141; 366/152; 366/160; 366/177; 366/182; 366/192; 137/599; 251/5; 425/DIG. 237

[58] Field of Search ..... 366/177, 184, 192, 51, 366/132, 141, 3, 5, 8, 10, 11, 16, 17-19, 21, 33, 40, 42, 101, 106, 107, 150, 154, 160, 161, 152, 162, 165, 167, 173-182, 262, 336-340, 138; 137/606, 599; 422/111, 257; 239/113, 143, 145, 427.3, 427.5, 432; 425/DIG. 237; 406/134; 251/5

[56] References Cited

U.S. PATENT DOCUMENTS

| | | | |
|---|---|---|---|
| 3,522,069 | 7/1970 | Checko et al. | 428/921 X |
| 3,625,724 | 12/1971 | Alvero | 366/10 X |
| 3,938,782 | 2/1976 | Robertson | 366/192 X |
| 4,182,383 | 1/1980 | Adomitis et al. | 137/625.21 X |
| 4,298,288 | 11/1981 | Weisbrod | 366/8 |
| 4,488,570 | 12/1984 | Jiskoot | 137/606 X |
| 4,498,496 | 2/1985 | Barcellona et al. | 137/606 X |
| 4,514,093 | 4/1985 | Coch et al. | 366/138 |
| 4,654,802 | 3/1987 | Davis | 366/8 X |

FOREIGN PATENT DOCUMENTS

| | | | |
|---|---|---|---|
| 2250619 | 6/1975 | France . | |
| 462789 | 11/1968 | Switzerland . | |
| 2164755 | 3/1986 | United Kingdom . | |
| 2195909 | 4/1988 | United Kingdom | 366/18 |

*Primary Examiner*—Philip R. Coe
*Assistant Examiner*—C. Cooley
*Attorney, Agent, or Firm*—Pravel, Gambrell, Hewitt, Kimball & Krieger

[57] ABSTRACT

An apparatus and method for controlling the production of foamed material in which the material and foam are delivered to a mixer (12) in predetermined relative proportions. The apparatus comprises a mixer (23) for mixing a foam solution and air together, and a foam generator (26) for conditioning the air and foam solution mixture and delivering the resultant foam to the mixer. The foam generator (26) comprises a plurality of foam generating chambers connected in parallel, valves (28) being provided to control the flow of air and foam solution mixture through each of the generator chambers. The volume flow rate at which foam is delivered to the mixer (12) is monitored, and the valves are controlled to direct the air and foam solution mixture through one or more of the generator chambers in dependence upon the volume flow rate such that the flow velocity of the air and foam solution mixture within the chamber or chambers is within predetermined limits.

7 Claims, 3 Drawing Sheets

FLOW CHART FOR VOID ESTIMATION

APPARATUS AND METHOD FOR PRODUCING FOAMED MATERIALS

This is a continuation application under 35 U.S.C. 120 and 35 U.S.C. 365(c) of international application PCT/GB88/00175 with an international filing date of Mar. 9, 1988 which designated the United States as a "Designated State."

The present invention relates to an apparatus and method for producing foamed material such as foamed concrete.

It is known to make articles such as structural members of lightweight concrete by expanding a wet concrete mix which is poured into a mould. Generally the concrete is lightweight, in comparison with conventional concrete, as a result of it containing a mass of gas bubbles, for example air bubbles. Such lightweight concrete has a relatively low thermal conductivity, a relatively low elastic modulus, and other desirable features. One technique for producing lightweight concrete is to add foam to a wet concrete mix so that it contains bubbles which remain trapped in the set concrete. The density of the lightweight concrete reduces as the amount of gas forming the bubbles increases. If there is too much gas in the concrete however, due for example to excessive foaming or expanding, or if the gas bubbles are too large or are not uniformly distributed, the lightweight concrete when set may be too weak for its intended purpose.

Since the density of lightweight concrete is a function of the gas bubble content in a given volume of the concrete, and the strength of the concrete is a function of the gas bubble content and its distribution, the density of and gas distribution within wet lightweight concrete is a measure of the strength that the concrete will have once set.

An apparatus and method for determining the density of foamed concrete is described in British Patent Specification No. 2,164,755. Using the method of the above-mentioned publication it is possible to determine the density and hence the gas content of a foamed concrete, but the density measurement does not indicate the quality of the product as the measurement is insensitive to variations in the gas bubble size and distribution.

A critical factor in the determination of the quality of a foamed concrete is the quality of the foam delivered for mixing with the raw concrete. In conventional foam concrete producing equipment a mixture of water and foaming solution is conditioned by passing it through a foam generator which comprises a chamber within which a labyrinthine series of passageways is defined. The chamber is designed such that for a given rate of throughput a turbulent pattern of flow is established to produce the required foam characteristics. With a single chamber the given rate of throughput can only be achieved if two other parameters are properly regulated, that is the rate of supply of the foam and the back pressure to which the foamed concrete is subjected. This means that conventional equipment has been designed to provide only a limited range of rates of concrete supply so that one equipment cannot be used in circumstances where a rate of supply outside its normal range would be advantageous. Furthermore, the back pressure can vary significantly, for example as the result of variations in the viscosity of the foamed concrete product or variations in the height to which the concrete product has to be pumped. It will be appreciated that the volume of foam passing through the foam generator will vary with variations in the pressure within the foam generator.

It is an object of the present invention to obviate or mitigate the above problems.

According to the present invention there is provided an apparatus for controlling the production of foamed material in which the material and foam are delivered to a mixer in predetermined relative proportions, comprising means for mixing a foam solution and air together, and a foam generator for conditioning the air and foam solution mixture and delivering the resultant foam to the mixer, wherein the foam generator comprises a plurality of foam generating chambers connected in parallel, valves are provided to control the flow of air and foam solution mixture through each of the generator chambers, means are provided for determining the volume flow rate at which foam is delivered to the mixer, and means are provided for controlling the valves to direct the air and foam solution mixture through one or more of the generator chambers in dependence upon the volume flow rate such that the flow velocity of the air and foam solution mixture within the chamber of chambers is within predetermined limits.

The invention also provides a method for controlling the production of foamed material in which the material and foam are delivered in predetermined relative proportions to a mixer, the foam being produced by mixing air and foam solution together and passing the air and foam solution mixture through a foam generator to the mixer, wherein the foam generator comprises a plurality of foam generator chambers connected in parallel, valves are provided to control the flow of air and foam solution mixture through each of the generator chambers, the volume rate at which foam is to be delivered to the mixer is determined, and the valves are adjusted to direct the air and foam solution mixture through one or more of the generator chambers such that the flow velocity of the air and foam solution mixture within the chamber or chambers is maintained within predetermined limits.

Preferably, the pressure at which foam is delivered to the mixer is monitored and foam solution and air are delivered to the foam generator at predetermined mass flow rates. The volume of foam delivered to the mixer is a function of both the mass flow rate of the foam and the delivery pressure. Thus the volume flow rate can be computed from the monitored pressure and the predetermined flow rates.

Alternatively, the pressure at which foam is delivered to the mixer can be maintained constant, in which case the volume flow rate of foam is a function of the air and foam solution mass flow rates only. The pressure may be maintained constant by a valve positioned downstream of the mixer and controllable to provide an adjustable resistance to the flow of material from the mixer. The pressure maintaining valve may be for example a pinch valve comprising a flexible conduit through which the material passes and the cross-sectional area of which may be adjusted by applying a differential pressure across the conduit wall.

The control valves associated with the foam generator may comprise one valve in respect of each generator chamber, each valve being switchable between an open condition in which it offers no resistance to the flow of mixture therethrough and a closed position in which the flow of mixture therethrough is prevented.

Embodiments of the present invention will now be described, by way of example, with reference to the accompanying drawings, in which.

Figure 1:
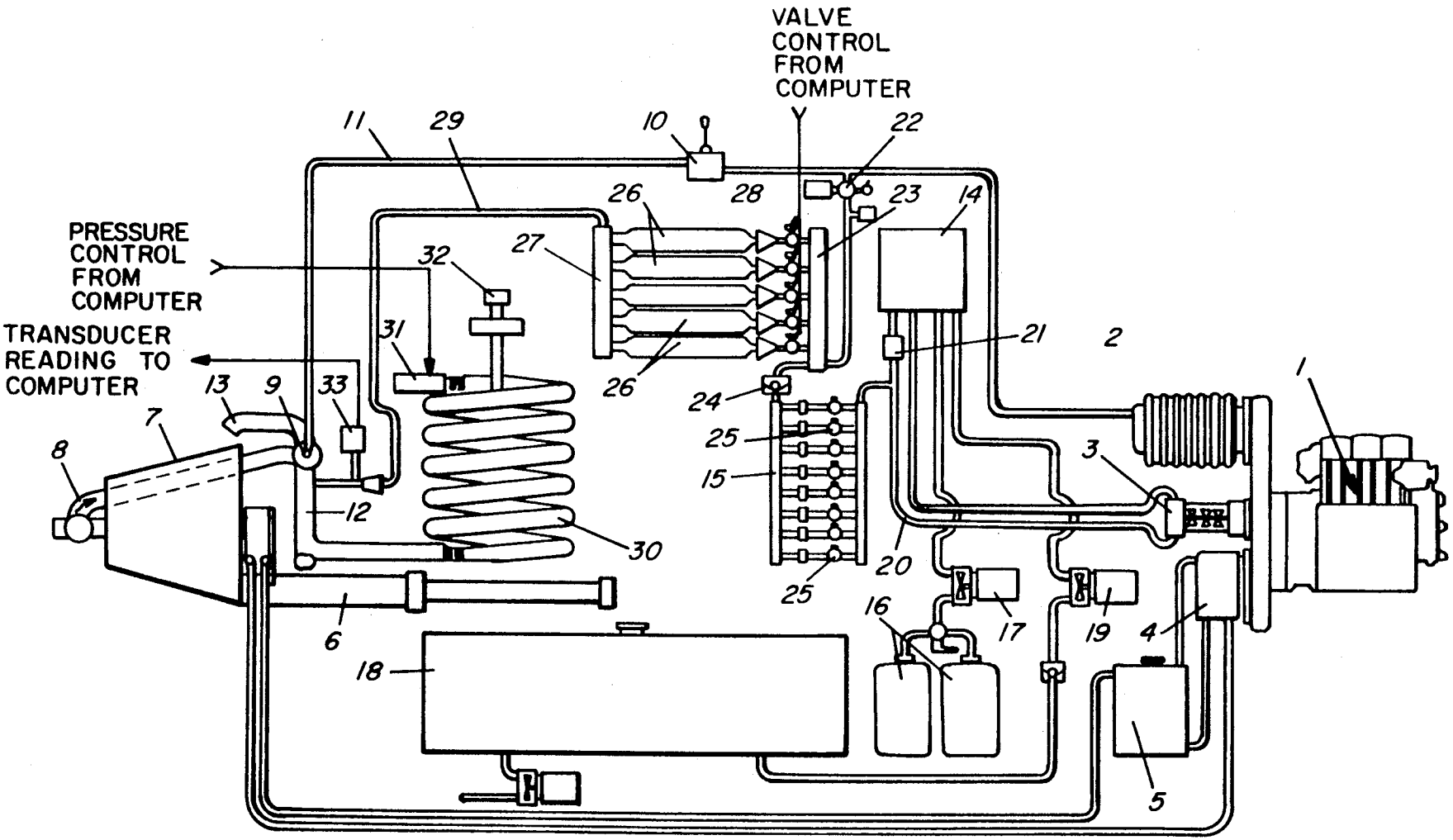
FIG. 1 is a schematic illustration of a foamed concrete producing machine in accordance with the invention.

Referring to FIG. 1, the illustrated foam concrete producing machine comprises a diesel engine 1 powering an air compressor 2, a solution pump 3 and a hydraulic pump 4. The hydraulic pump 4 supplies pressurized hydraulic fluid from a reservoir 5 to a concrete pump 6 which draws raw concrete from a hopper 7 and pumps the raw concrete through a pipe 8 to a concrete supply control valve 9. The air compressor 2 supplies compressed air to a control valve 10 which can be manually actuated to supply a controlling pneumatic pressure signal on pneumatic line 11 to the concrete supply control valve 9. Depending upon the pressure in line 11 the valve 9 either supplies raw concrete to a static mixer 12 or returns concrete via pipe 13 to the hopper.

The solution pump controls the supply of a foaming solution from a tank 14 to a solution metering unit 15. The tank 14 is supplied with a foaming solution concentrate from reservoirs 16 by a pump 17. The tank 14 is supplied with water from a water tank 18 by a pump 19. The solution pump 3 supplies pressurized solution in line 20 which is maintained at a substantially constant pressure by a pressure release valve 21.

The air compressor supplies compressed air via motorized air valve 22 to a mixing chamber 23. The mixing chamber 23 also receives solution from the solution metering unit 15 via non-return valve 24. The volume of air supplied is determined by the setting of the motorized air valve 22. The volume of solution supplied is determined by a series of eight parallel arranged valves 25 which are either fully open or fully closed. Thus the rate of solution supplied can be predetermined by selective opening of one or more of the valves 25 to provide any one of 255 possible supply rates.

The output from the mixing chamber 23 is supplied to a foam generator comprising five foam generator chambers 26 which are arranged in parallel and each of which feeds a common output chamber 27. Each of the chambers 26 is designed in accordance with conventional techniques to provide an appropriately conditioned foam output assuming an appropriate volume rate of flow therethrough. A series of five valves 28 are arranged in series with respective ones of the chambers 26, each valve 28 being arranged to be either fully open or fully closed. Thus by selectively controlling the five valves 28 the total flow of foam can be passed through either one, two, three, four or five of the foam generator chambers 26. This gives a wide range of foam delivery rates which can be accommodated whilst still maintaining appropriate conditions within the individual chambers.

The output chamber 27 is connected by line 29 to the static mixer 12. The static mixer which is of conventional design ensures good mixing of the foam and raw concrete and that mixture is delivered via a weighing coil 30 to an output 31. The weighing coil 30 is supported on a load cell 32 which provides an output enabling the calculation of the density of the concrete within the coil 30 in accordance with the techniques described in the abovementioned British Patent Specification No. 2,164,755.

The pressure within the line 29 is determined by a pressure transducer 33 which is a measure of the back pressure to which the concrete within the coil 30 is subjected.

When it is desired to deliver foam concrete in a particular application the control valve 10 is set to position the concrete supply valve 9 such that the appropriate rate of supply of raw concrete is established. A computer system (not illustrated) then calculates the required rate of supply of foam in accordance with the desired final product density which is calculated using conventional techniques. The actual volume rate of supply of foam is however a function of the back pressure and this back pressure is sensed by the transducer 33. Using the input provided by the transducer 33 it is simple to calculate the volume rate of flow through the foam generator. Given that calculation the valves 28 can be opened selectively to distribute the flow of solution through the chambers 26 such that each chamber which is brought into operation has a flow through it which ensures that the resultant foam has the desired characteristics. A relatively wide range of foam concrete supply rates can accordingly be accommodated whilst maintaining a high quality foam. One machine can therefore be easily adapted to supply a high quality foam concrete in a variety of circumstances. The pressure within the coil 30 will vary considerably in dependence upon the viscosity of the foam concrete and the height to which it must be pumped but variations in this back pressure are taken into account by virtue of the provision of the transducer 33 and the response of the control system of the machine to the output of that transducer.

As an alternative to the described arrangement which compensates for variations in the back pressure within the coil 30, steps can be taken to maintain that back pressure constant. This can be achieved by fitting a pinch valve in the output 31 of the coil 30 and controlling that pinch valve by an appropriate feedback mechanism linked to the transducer 33 so that the pressure within the coil 30 is stabilized. If the back pressure is stabilized the pressure within the foam generator chambers 26 is also stabilized and the valves 28 can then be controlled simply on the basis of the preset rate of supply of foamed concrete product. It will be appreciated that if the pressure within the foam generator chambers 26 is always substantially constant the volume rate of flow through the foam generator will always be proportional to the mass rate of flow through the foam generator.

Figure 2:
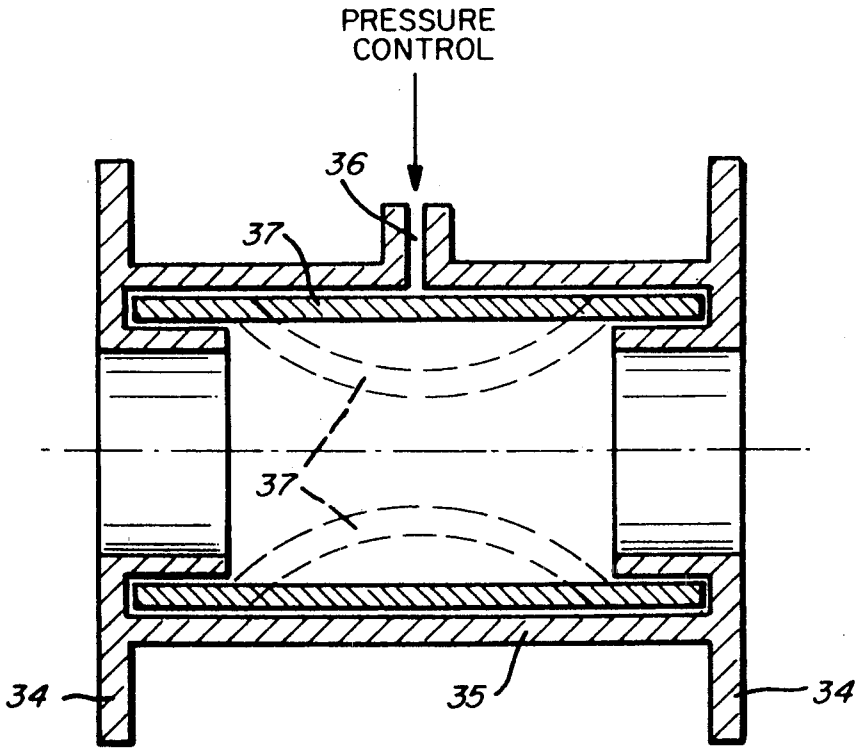
FIG. 2 is a schematic illustration of a pinch valve suitable for use in a modification to the machine illustrated in FIG. 1.

Referring to FIG. 2, a pinch valve suitable for fitting in the output 31 of the coil 30 as described above is illustrated. The pinch valve comprises end flanges 34 enabling it to be connected in an output pipe, the flanges being supported at opposite ends of a cylindrical tube 35 provided with a gas inlet 36. Arranged around the inner surface of the tube 35 is a flexible elastomeric tube 37. If the pressure within pipe 36 is less than that within the tube 37 the tube 37 assumes the position shown in which it is supported by the tube 35. If however it is desired to reduce the cross section of the tube 37 a differential pressure can be applied across the wall of the tube 37 so that it is forced inwards to assume the position shown in dotted lines. The degree of distortion of the tube 37 will of course be a function of the differential pressure across the wall of the tube 37. By restricting the cross section of the tube 37 the resistance to flow represented by the pinch valve can be closely controlled and accordingly the pressure upstream of the pinch valve can be maintained substantially constant by an appropriate feedback loop.

The addition of a pinch valve to the system permits the introduction of suitable software such that the system can be used to measure and control the void content as well as the density of a void containing or foamed mixture such as foam concrete.

Figure 3:
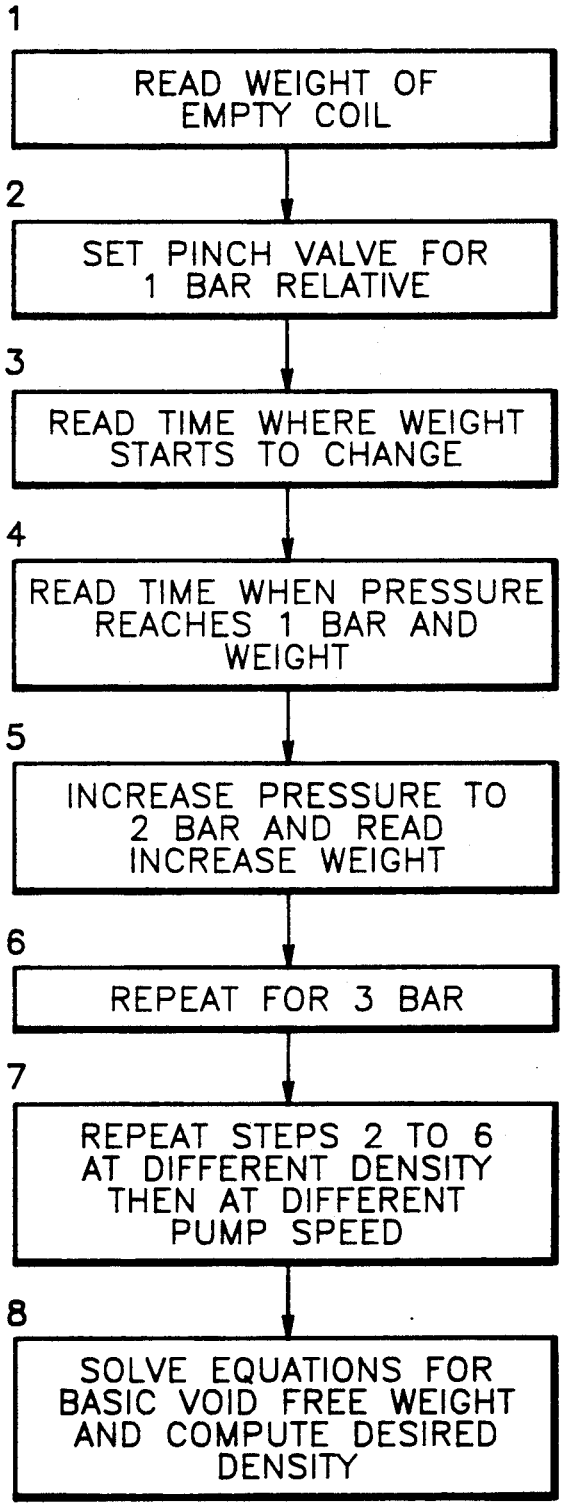
FIG. 3 is a flow chart illustrating a procedure which can be followed to measure and control the void content and density of a foamed concrete mixture.

A suitable sequence is shown in the flow chart illustrated in FIG. 3, the same procedure also permitting automatic calibration of the system.

I claim:

1. An apparatus for controlling the production of foamed material in which the material and foam are delivered to a material and foam mixer in predetermined relative proportions, comprising:

mixing chamber means for mixing a foaming solution and air together;

a foam generator for conditioning the air and foaming solution mixture into a resultant foam and delivering the resultant foam to the material and foam mixer, wherein said foam generator comprises: a plurality of foam generating chambers connected in parallel, and control valves between said mixing chamber means and said foam generating chambers to control the flow of air and foaming solution mixture through each of said generator chambers;

means for determining the volume rate at which the resultant foam is delivered to the material and foam mixer; and means for controlling said control valves to direct the air and foaming solution mixture through one or more of said foam generating chambers in dependence upon the volume flow rate therethrough such that the flow velocity of the air and foaming solution mixture within said foam generating chamber or chambers is within predetermined limits.

2. An apparatus according to claim 1, comprising means for monitoring the pressure at which the resultant foam is delivered to the material and foam mixer and means for delivering the foaming solution and air to the said foam generator at predetermined mass flow rates, the volume of resultant foam delivered to the material and foam mixer being a function of both the mass flow rate of the resultant foam and the delivery pressure.

3. An apparatus according to claim 1, comprising means for maintaining constant the pressure at which the resultant foam is delivered to the material and foam mixer such that the volume flow rate of the resultant foam is a function of the air and foaming solution mass flow rates only.

4. An apparatus according to claim 3, wherein the foam delivery pressure is maintained constant by a pressure maintaining valve positioned downstream of the material and foam mixer and controllable to provide an adjustable resistance to the flow of material from the material and foam mixer, and means for controlling the pressure on said pressure maintaining valve to adjust the resistance to flow of material from the material and foam mixer.

5. An apparatus according to claim 4, wherein said pressure maintaining valve is a pinch valve comprising a flexible conduit through which the material passes and the cross-sectional area of which may be adjusted by applying a differential pressure across the conduit wall.

6. An apparatus according to claim 4, wherein said control valves associated with said foam generator comprise one control valve connected with each said generator chamber, each said control valve being switchable between an open condition in which it offers no resistance to the flow of air and foaming solution mixture therethrough and a closed position in which the flow of air and foaming solution mixture therethrough is prevented.

7. A method for controlling the production of foamed material in which the material and foam are delivered in predetermined relative proportions to a material and foam mixer, comprising the steps of:

mixing air and a foam solution together to form a resultant foam mixture;

passing the resultant foam mixture through a foam generator to the material and foam mixer, wherein the foam generator comprises a plurality of foam generator chambers connected in parallel, with valves provided to control the flow of air and foam solution mixture through each of the generator chambers;

determining the volume rate at which the resultant foam mixture is to be delivered to the material and foam mixer; and adjusting the valves to direct the air and foaming solution mixture through one or more of the generator chambers such that the flow velocity of the air and foaming solution mixture within the chamber or chambers is maintained within predetermined limits.

* * * * *